United States Patent [19]

McIntyre et al.

[11] 4,348,429

[45] Sep. 7, 1982

[54] PROCESS FOR SILVER COATING OF PERMEABLE SUBSTRATES

[75] Inventors: James A. McIntyre; Robert F. Phillips, both of Midland; Joseph D. Lefevre, Bay City, all of Mich.

[73] Assignee: The Dow Chemical Company, Midland, Mich.

[21] Appl. No.: 939,589

[22] Filed: Sep. 5, 1978

[51] Int. Cl.[3] ..... B05D 5/12; C23C 3/02

[52] U.S. Cl. ..... 427/125; 427/115; 427/247; 427/304; 427/306; 427/345; 427/437

[58] Field of Search ..... 427/115, 430 A, 437, 427/345, 275, 125, 247, 304, 306

[56] References Cited

U.S. PATENT DOCUMENTS

| | | | |
|---|---|---|---|
| 2,409,295 | 10/1946 | Marvin et al. | 427/247 |
| 2,791,516 | 5/1957 | Chambers | 427/345 |
| 2,881,100 | 4/1959 | Handman et al. | 427/345 |
| 2,955,944 | 10/1960 | Spaulding | 427/244 |
| 3,025,188 | 3/1962 | Larsh et al. | 427/345 |
| 3,140,188 | 7/1964 | Zirngiebl | 106/1 |
| 3,338,726 | 8/1967 | Berzins | 106/1 |
| 3,539,469 | 11/1970 | Schroeder | 252/474 |
| 3,565,667 | 2/1971 | Klingspor | 427/345 |
| 3,597,267 | 8/1971 | Mallory | 427/430 A |
| 3,787,244 | 1/1974 | Schulmeister | 136/120 FC |
| 3,864,236 | 2/1975 | Lindstrom | 204/265 |

FOREIGN PATENT DOCUMENTS

| | | | |
|---|---|---|---|
| 921111 | 2/1973 | Canada | 427/430 A |
| 1177897 | 3/1974 | Fed. Rep. of Germany | 427/247 |

OTHER PUBLICATIONS

Nature, vol. 201, 1212 (1964), A New Fuel Cell Cathode Cathode Catalyst-Jasinski (I).

J. Electrochem. Soc., vol. 112, No. 5, 526 (1965), Cobalt Phthalocyanine-Jasinski (II).

J. Applied Electrochem., 3, 214 (1973), Carbon electrode with Phthalocyanine-Musilova et al.

J. Catalysis, vol. 29, 8 (1973)-Contour et al.

Pearlstein, *Plating,* 61, p. 154 (1974), "Electroless Deposition of Silver using Dimethylamine Borane".

*Primary Examiner*—Norman Morgenstern
*Assistant Examiner*—Richard Bueker
*Attorney, Agent, or Firm*—James H. Dickerson, Jr.

[57] ABSTRACT

A permeable substrate is coated with a film of silver deposited from an aqueous electroless silver plating solution. The process provides substantially total extraction or depletion of the silver from the solution. The process permits deposition of closely controlled amounts of silver on well-defined permeable areas.

9 Claims, 2 Drawing Figures

PROCESS FOR SILVER COATING OF PERMEABLE SUBSTRATES

BACKGROUND OF THE INVENTION

The electrolytic and electroless plating of silver on various substrates has a long history. One of the applications of electroless plating is in the area of oxygen electrodes, e.g., in fuel cells and electrolytic cells. In recent times, U.S. Pat. No. 3,864,236, granted Feb. 4, 1975, disclosed an air cathode having two porous layers, the coarse or inside layer containing commingled catalyst which may be silver. The air cathode is said to be made of a mixture of catalyst, carbonyl-nickel powder and spacer which are pressed and sintered together to a desired porosity. The fine layer, exposed to the catholyte, does not contain catalyst. In preparation, the fine layer which does not contain catalyst or spacer is first put into a mold. Then the coarse layer powder is put on top of the fine layer followed by sand and the composite is pressed together, e.g., at one ton/cm$^2$ (1000 kg/cm$^2$).

F. Pearlstein and R. F. Weightman, Plating 61, 154 (1974) [following up their earlier report in Plating 58, 1014 (1971) and that of N. Feldstein, RCA Review 31, 317 (1970) on the catalyzed reduction of silver ions by dimethylamine borane] reported on an electroless silver plating technique using 2.0 g/l dimethylamine borane, 1.34 g/l AgCN, 1.49 g/l NaCN (wherein $NaAg(CN)_2$ is formed in excess of NaCN) and 0.75 g/l NaOH in distilled water. Deposition at a constant rate was described for 10 cm$^2$ solid silver panels which were soak alkaline cleaned, rinsed, immersed in aqueous sodium hydroxide and sodium cyanide mixture to remove tarnish, rinsed, immersed in aqueous dilute palladium chloride-hydrochloric acid solution to insure presence of an active surface for initiating electroless deposition, rinsed, dried and weighed. Silver was thereafter deposited on the prepared silver panels using 500 ml of the solution described above for one hour at 55° C. at a rate of about 2.5 μm/hr.

Bregoli et al., in Canadian Pat. No. 921,111, granted Feb. 13, 1973, disclosed a controlled potential pulse plating method. In this electroplating method, a potential is applied to a porous electrode structure (the cathode) which is immersed in a plating solution which can be a solution of a silver compound. The potential is applied in pulses by a complicated apparatus which would appear to be difficult to apply routinely. The porous electrode structure is catalyst activated after fabrication, which may be by sintering or otherwise, to give an electrode suitable for fuel cells.

Schulmeister et al., in U.S. Pat. No. 3,787,244, granted Jan. 22, 1974, disclosed a porous or sintered fuel cell electrode which is catalyzed by a replacement plating process. The substrate may be porous nickel. Noble metal ions from a dissolved salt replace a thin layer of the nickel surface within the pores. In their process, the solution containing one or more noble metal salts is poured on top of the porous electrode and a partial vacuum is drawn on the bottom side of the electrode.

Schroeder et al., in U.S. Pat. No. 3,539,469, granted Nov. 10, 1970, disclosed a fuel cell cathode catalyst comprising a nickel powder, the particles of which are coated with silver. Nickel powder is immersed in dilute acid to activate its surface and a silver salt is then added to the acid solution whereby metallic silver replaces surface nickel. The silver-coated nickel powder is then washed and heat treated, then compacted into an electrode.

Zirngiebel and Klein, in U.S. Pat. No. 3,140,188, granted July 7, 1964, disclosed that certain borazane or borane compounds having the given structure $R_3N$-$BH_3$, wherein R is said to denote an alkyl or aryl radical or H, then denominated borazanes and including, for example, N,N,N-trimethylborazane, N,N-dimethylborazane, N-methylborazane, N,N-diethylborazane, N,N,N-triethylborazane, are useful as reducing agents in electroless baths for plating iron, cobalt, nickel and zinc on appropriate plastic films or metal sheets.

Berzins, in U.S. Pat. No. 3,338,726, granted Aug. 29, 1967, also found such amine boranes, particularly the tertiary amine boranes and including pyridine borane, useful as reducing agents in electroless plating solutions containing nickel and cobalt ions for producing nickel-boron and cobalt-boron alloy plates.

Mallory et al., in U.S. Pat. No. 3,597,267, granted Aug. 3, 1971, also found that the amine boranes such as dimethylamine borane and morpholine borane are useful as reducing agents in a bath for the electroless plating of Ni, Co, Fe and Cr on Bi, Cd, Sn, Pb and Zn substrates.

It is desired to provide a ready method for depositing accurately known amounts of silver over substantially the whole exposed surface of a permeable substrate.

SUMMARY OF THE INVENTION

This invention concerns a method for depositing accurately known amounts of silver substantially uniformly over the whole exposed surface of a permeable substrate. The method permits deposition of a controlled amount of the silver in the bath of an electroless plating solution by circulating and recirculating the plating solution in a direction which forces upwardly hydrogen given off in the silver deposition reaction until the silver content of the plating bath is substantially exhausted.

DETAILED DESCRIPTION OF THE INVENTION

In the process of this invention, there is used a permeable mass, e.g., of a Group IB or Group VIII heavy metal, such as nickel, cobalt, iron and copper, or organic or inorganic particles or beads described below to give a product having a permeability or pore volume between about 20 and about 80 percent.

The permeable mass, if not commercially available, can be produced in various ways, for example, by mechanically pressing and sintering particles of a desired metal, or casting an alloy or mechanical mixture, e.g., of Al-Ni, and dissolving out the undesired component; or by forming a cellular metal, e.g., nickel, by the electrolytic method of U.S. Pat. No. 4,053,371 wherein an open-cell structure is obtained.

The permeable product is thereafter plated on its surface with silver in an electroless process wherein the plating solution contains a silver compound and a reducing agent. Preferably the plating solution contains as a reducing agent an amine borane, as defined below. A preferred plating bath is composed of an aqueous solution or mixture of an alkali metal silver cyanide, advantageously sodium silver cyanide, obtained by mixing silver cyanide with excess alkali metal cyanide; an alkali metal hydroxide, advantageously sodium hydroxide; and an amine borane. Such an electroless plating solution is similar to that revealed by Pearlstein and Weightman, Plating 61, 15 (1974).

In the inventive process, the plating solution is circulated in a manner which forces upwardly hydrogen given off in the silver deposition. This may be by upward or sidewise circulation wherein the normally rising byproduct hydrogen is swept out from interstitial pores and is vented. In the process, build up of trapped hydrogen in the porous mass is substantially completely prevented, so that fresh plating solution is able to reach the exposed surfaces. The circulation of the plating solution also substantially completely removes trapped air which is normally originally present in the permeable mass and would otherwise also interfere with the surface plating of the silver.

Advantageously, the electroless plating solution is recirculated until the bath leaving the particulate mass is substantially silver free. The importance of being able to determine simply and readily when the plating bath is substantially free of silver is that it is then possible to determine precisely what amount of silver has been deposited. The simple technique herein used is to take a disposable glass transfer pipet 5¾ in (14.67 cm) long or equivalent fine glass tube having a taper, attach it to a 1 to 2 ml syringe or equivalent aspirator and draw up about 0.1 to 0.2 ml of aqueous 1:1 hydrochloric acid. The pipet is removed from the hydrochloric acid, wiped to avoid contamination, a small air space is drawn and then a sample of about 0.1 to 0.2 ml of plating solution is drawn in. After removing the pipet, both of the solutions in it are carefully drawn above the taper. The two solutions there mix and the presence or absence of a silver chloride precipitate indicates whether the solution is silver free. Of course, other ways for determining the presence or absence of silver in the plating solution can be substituted, e.g., the well-known 5-(p-dimethylaminobenzylidene)rhodanine spot test.

The plating solution is circulated through the permeable mass at a usual plating temperature. When an amine borane is present as a reductant in the plating solution, a plating temperature between about 20° and about 50° C. is useful, since at about 55° C. such a plating solution decomposes. The silver plating rate generally increases with increasing temperature.

Since silver deposition from the plating bath would take place at active metallic surfaces, the recirculation systems are all nonactive. Peristaltic pumps are advantageously used for convenience, but any pump with a nonactive head can be used to recirculate the plating bath.

While heavy metals such as nickel, cobalt, iron and copper can be plated directly with silver from the electroless plating bath, non-metallic permeable substrates having spaces between their particles or having an open-cell structure such as those of plastics, e.g., styrene-divinylbenzene copolymers, polytetrafluoroethylene, glass, clay, polyethylene, polypropylene and graphite particles or beads and particulate titanium can similarly be silver plated if they are first catalyzed or sensitized, e.g., with mixed stannous chloride/palladium chloride catalysts, for example, those disclosed by E. Matijevic et al., "Plating and Surface Finishing" 62, 958 (1975).

In addition to the preferred electroless silver plating bath described below, other electroless silver plating baths may similarly be used. These include solutions of silver compounds such as a silver salt, together with a conventional reducing agent, as known in the electroless plating art.

In preparing the electroless plating solutions, care should be taken to remove any solid material which would clog the pores in the substrate. Cyanide solutions should be filtered through filter paper, for example. Normally, the preferred amine borane reductant and the alkali metal hydroxide solutions do not require filtering. Preferably, the amine borane solutions should be relatively freshly prepared. A decrease in reductive activity is noted if the amine borane solution is more than two months old. Stock solutions of the various ingredients are advantageously used. They should each be added to an appropriate amount of water, since mixing undiluted stock solutions may result in decomposition.

As used herein, an amine borane defines a compound corresponding to the formula $R_3NBH_3$ wherein R represents up to three substituents of the group H and 1 to 4 carbon lower alkyl groups and $R_3N$ as an entity represents pyridine or morpholine. Such compounds as amine borane, $NH_3BH_3$, monomethylamine borane, $CH_3NH_2BH_3$, dimethylamine borane, $(CH_3)_2NHBH_3$, diethylamine borane, $(C_2H_5)_2NHBH_3$, trimethylamine borane, $(CH_3)_3NBH_3$, triethylamine borane, $(C_2H_5)_3NBH_3$, t-butylamine borane, t-$C_4H_9NH_2BH_3$, pyridine borane,

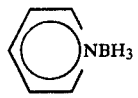

and morpholine borane,

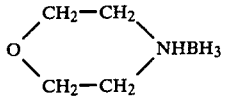

are useful reductants in the electroless silver plating baths used in this invention.

In practice, a preferred electroless silver plating bath is made up, advantageously from stock solutions in distilled water of concentrates which are (1) about one-third molar in the amine borane, (2) about 0.2 molar in the alkali metal hydroxide and (3) a mixture of about 0.3 molar alkali metal cyanide, e.g., NaCN and about 0.1 molar AgCN to give, e.g., NaAg $(CN)_2$ dissolved in excess NaCN. High quality and preferably reagent-grade chemicals are used. The cyanide solution is best filtered through filter paper. The stock solutions are diluted with distilled water to plating bath concentrations and mixed to give a final solution of about 0.008 to about 0.012 molar alkali metal silver cyanide, e.g., $NaAg(CN)_2$, about 0.016 to about 0.024 molar alkali metal cyanide, about 0.016 to about 0.024 molar alkali metal hydroxide and about 0.024 to about 0.036 molar in the amine borane.

The electroless silver plating solution so prepared is then circulated through a permeable substrate in a suitable retaining means such as a frame held together by means of gaskets or sealing with an epoxy or similar cement or both gaskets and cement. The circulation is in a direction which forces upwardly hydrogen which is given off in the reaction.

The solution is recirculated until all or substantially all of the silver in the solution is deposited, as determined by one of the earlier described methods.

The silver plated products are useful as oxygen-depolarizing cathodes, in the manufacture of buttons and the like.

BRIEF DESCRIPTION OF THE DRAWINGS

The accompanying drawings are illustrative of the invention wherein.

DESCRIPTION OF THE PREFERRED EMBODIMENTS

Figure 1:
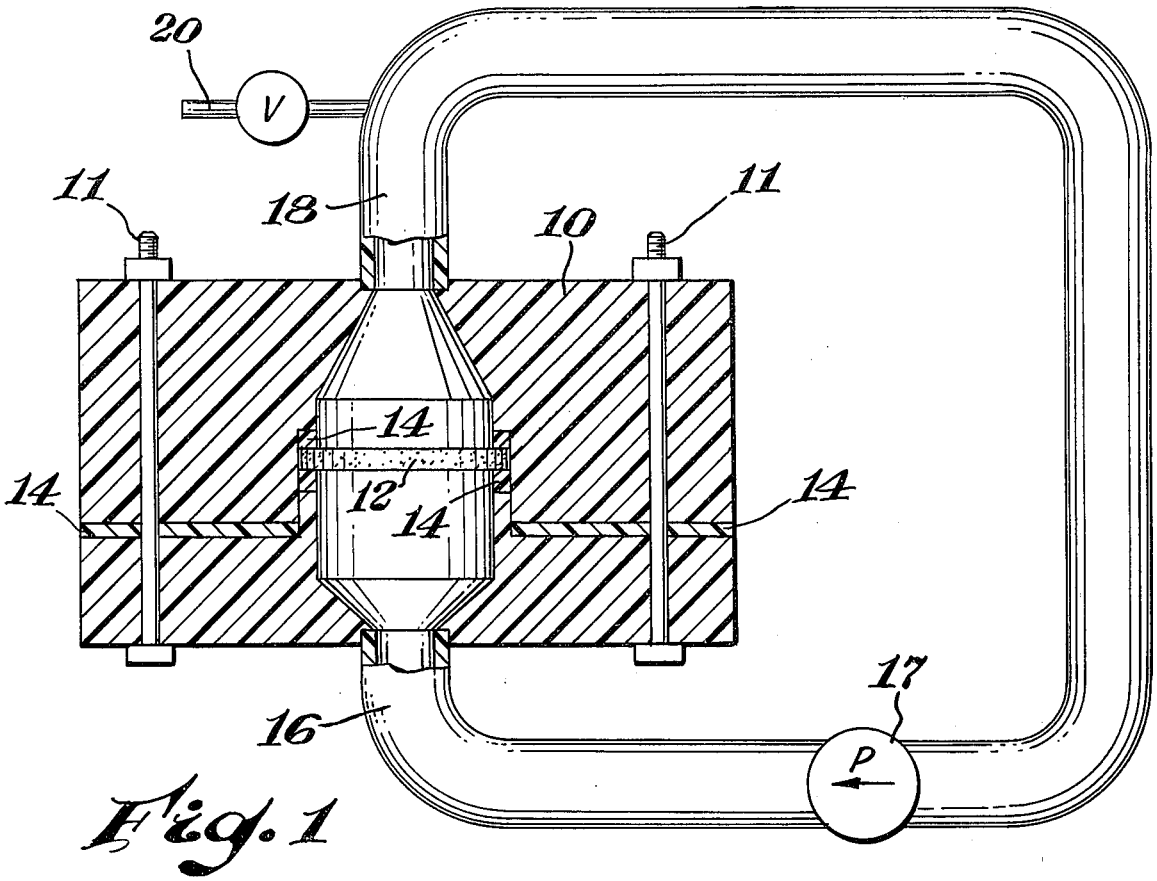
FIGS. 1 and 2 are cross-sectional views of representative embodiments of apparatuses for preparing silver coated porous surfaces. Identical numbers, distinguished by a letter suffix, represent parts within the figures having a similar function.

In FIG. 1 is represented a porous particulate substrate 12 held with its largest dimension in a horizontal position in holding frame 10 wherein gaskets 14 maintain a tight seal when fastening means 11, advantageously having threaded ends to which nuts are attached or clamping means, are suitably tightened. Pumping means 17, advantageously a peristaltic pump or any pump with a nonactive head, is removably connected in a circulating system wherein an electroless silver plating solution, as described above, is pumped upwardly through inlet 16 and passes through permeable substrate 12 and through outlet 18 for recirculation by pump 17 until all or substantially all of the silver in the plating solution is exhausted. Periodically, a sample is drawn through valved sampling means 20 for one of the silver tests described above to determine when the plating solution has been exhausted of its silver content.

Figure 2:
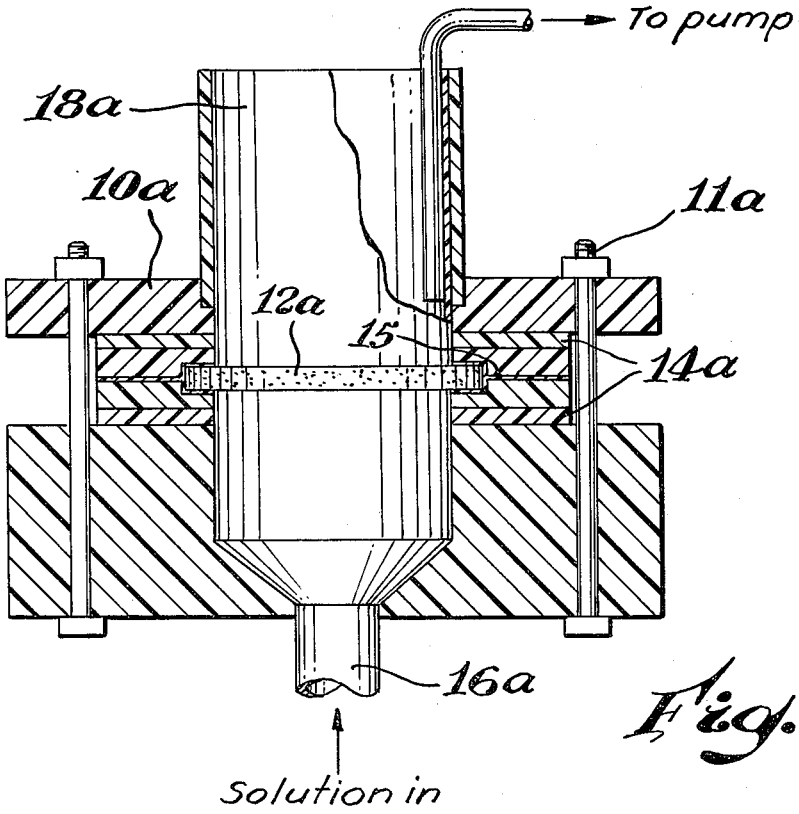

In FIG. 2 is represented a similar arrangement wherein epoxy cement 15 and gaskets **14*a* are used to maintain a seal about the permeable substrate 12*a*. Here, too, a pumping means, not shown, having a nonactive head recirculates the electroless silver plating solution upwardly through substrate 12*a*** until a sample withdrawn through a sampling means, not shown, indicates that no or substantially no silver remains in the plating solution.

In the practice of the inventive process, the permeable substrate can be degreased when necessary with an appropriate degreasing solvent, e.g., acetone, methylene chloride or other chlorinated hydrocarbon solvent. It is then mounted in a frame such as is described in FIG. 1 or FIG. 2 and an electroless silver plating bath is then circulated and recirculated upwardly through the particulate mass until all or substantially all of the silver in the plating bath is exhausted. Thereby there is obtained a permeable mass having silver plated on its exposed surfaces.

If the permeable substrate is composed of styrene-divinylbenzene, tetrafluoroethylene or other organic plastics or inorganic particulates such as those of glass, clay, graphite or the like or particulate titanium, the particles (after being mechanically compressed or sintered to give a coherent permeable mass having about 20 to about 80 percent pore volume) are first sensitized in known ways, e.g., with a wash of a mixed stannous chloride/palladium chloride catalyst solution prior to being mounted in a holder and electroplated as described above.

The following examples additionally describe representative specific embodiments of the invention and the best mode contemplated by the inventors of carrying out the invention.

EXAMPLE 1

A solution in distilled water was prepared which contained 1.49 g/l NaCN, 1.34 g/l AgCN, 0.75 g/l NaOH and 2.0 g/l dimethylamine borane wherein $NaAg(CN)_2$ formed in the presence of the excess NaCN. The resulting solution in quadruplicate, each containing 0.0109 g silver, was recirculated upwardly through each of four weighed porous 9/16 in. (1.43 cm diameter) nickel discs having a pore volume of about 80 percent which had first been washed with acetone to be sure they were grease free. A holder like that of FIG. 1 was used. The solutions were maintained at about 50° C. until all of the silver had been exhausted from each bath, as determined by the silver chloride pipet test described above. It was found that more than 99 percent of the silver had been deposited. A very small amount of nickel was found to have been dissolved, as determined by a conventional atomic absorption analytical technique. This explained why the weight gain did not correspond exactly to the total amount of silver in the electroless plating solutions. Test data follow in Table 1.

TABLE 1

| | DISC | | | |
|---|---|---|---|---|
| | A | B | C | D |
| Weight Gain, Grams | .0087 | .0077 | .0080 | .0094 |
| Residual Ag | .00007 | .00005 | .00005 | .00012 |
| Ni in Solution | .00200 | .00350 | .00300 | .00150 |
| Total | .0108 | .0113 | .0111 | .0110 |

EXAMPLE 2

A 25-ampere flat plate electrolytic cell was constructed using a titanium anode coated with oxides of ruthenium and titanium, a duPont Nafion 390 ion exchange membrane and a silver catalyzed (0.4 oz/ft$^2$, 11.34 g/0.093 m$^2$) 3- and 10-micron pore size dual porosity nickel cathode having an overall pore volume of about 70 percent. The anode and cathode were 5 in. by 10 in. (12.7 cm by 25.4 cm) in size. The anode-cathode spacing was $\frac{3}{8}$ in. (0.95 cm).

The cathode was prepared by sintering together at about 900° C. 3-micron and 10-micron particulate nickel to give a 0.02 in. (0.051 cm) thick layer of 3-micron and a 0.05 in (0.127 cm) thick layer of 10-micron nickel particulate. The silver loading followed the process described above, with dimethylamine borane as the reductant.

The cathode was spaced apart from the side wall of the cell to form a gas compartment between the cathode and the inner surface of the side wall, in the manner described and illustrated in Gritzner, U.S. Pat. No. 3,923,628, FIG. 2 and Column 5, the first paragraph. In the instant case, the fine particle size layer faced the catholyte.

The cell was operated at 25 amperes for 76 days with sodium chloride brine maintained at about 70° C. wherein oxygen or air or nitrogen were individually fed into the gas compartment at a pressure of about 3.5 psig. The caustic strength was maintained at 100 g/l by a controlled addition of water. Typical voltages were 2.27 volts on oxygen, 2.46 volts on air and 3.18 volts on nitrogen. As would be expected, depolarization and lowest voltage operation was best with oxygen. The performance on air was not as good as on oxygen, due to the diluting effect of the nitrogen present. With nitrogen, there was no depolarization of the cathode, of course, hence the voltage differential of −0.91 volt as between no depolarization (on nitrogen) and substantially complete depolarization (on oxygen).

Other substrates, e.g., those of other heavy metals, organic plastics, glass, clay and graphite, in permeable cellular, particulate solid or bead form, as described earlier, can be substituted in the silver plating process of this invention to give useful products, in particular, oxygen and air depolarizing cathodes for electrolytic cells, buttons and the like.

What is claimed is:

1. A process for the electroless deposition of a known amount of silver onto a porous substrate wherein an aqueous electroless plating solution containing a reducible silver compound is circulated and recirculated through the porous substrate until the silver content of the solution is substantially exhausted, the circulation of the plating solution being in a direction which forces upwardly hydrogen evolved in the silver deposition reaction.

2. The process of claim 1 wherein the electroless plating solution also contains an amine borane as a reducing agent.

3. The process of claim 1 wherein the electroless plating solution contains a reducible silver compound and an amine borane as a reducing agent.

4. The process of claim 1 wherein the aqueous solution originally consists essentially of the following proportions of components dissolved in distilled or deionized water: about 0.008 to about 0.012 molar alkali metal silver cyanide, about 0.016 to about 0.024 molar alkali metal cyanide, about 0.016 to about 0.024 molar alkali metal hydroxide and about 0.024 to about 0.036 molar amine borane.

5. The process of claim 4 wherein the dissolved components of the aqueous solution originally consist essentially of about 0.008 to about 0.012 molar sodium silver cyanide, about 0.016 to about 0.024 molar sodium cyanide, about 0.016 to about 0.024 molar sodium hydroxide and about 0.024 to about 0.036 molar dimethylamine borane.

6. The process of claim 1 wherein the substrate is a permeable metal substrate wherein the metal is above silver in the electromotive series wherein the aqueous electroless plating solution is prepared by mixing aqueous alkali metal cyanide, silver cyanide, alkali metal hydroxide and an amine borane, and is circulated and recirculated in a direction which forces upwardly hydrogen evolved in the silver deposition reaction at a temperature between about 20° and about 50° C. until the silver content of the solution is substantially exhausted.

7. The process of claim 1 wherein the substrate is a preformed particulate porous mass of a member of the group consisting of organic plastics, glass, clay, graphite and titanium and wherein the porous mass is first sensitized with a sensitizing agent.

8. The process of claim 1 wherein the substrate is a preformed particulate porous nickel substrate wherein an electroless aqueous plating solution, prepared by mixing aqueous alkali metal cyanide, aqueous silver cyanide, aqueous alkali metal hydroxide and aqueous amine borane, is circulated and recirculated in a direction which forces upwardly hydrogen given off in the silver deposition reaction at a temperature between about 20° and about 50° C. until the silver content of the solution is substantially exhausted.

9. The process of claim 8 wherein the dissolved components of the plating solution originally consist essentially of about 0.008 to about 0.012 molar sodium silver cyanide, about 0.016 to about 0.024 molar sodium cyanide, about 0.016 to about 0.024 molar sodium hydroxide and about 0.024 to about 0.036 molar dimethylamine borane.

* * * * *